US012264543B2

(12) United States Patent
Smith

(10) Patent No.: US 12,264,543 B2
(45) Date of Patent: Apr. 1, 2025

(54) DRILL STRING JOINT FOR HORIZONTAL DIRECTIONAL DRILLING SYSTEM

(71) Applicant: Vermeer Manufacturing Company, Pella, IA (US)

(72) Inventor: Jacob Richard Smith, Altoona, IA (US)

(73) Assignee: Vermeer Manufacturing Company, Pella, IA (US)

( * ) Notice: Subject to any disclaimer, the term of this patent is extended or adjusted under 35 U.S.C. 154(b) by 250 days.

(21) Appl. No.: 18/006,704

(22) PCT Filed: Jul. 20, 2021

(86) PCT No.: PCT/US2021/042435

§ 371 (c)(1),
(2) Date: Jan. 24, 2023

(87) PCT Pub. No.: WO2022/026252

PCT Pub. Date: Feb. 3, 2022

(65) Prior Publication Data

US 2023/0272679 A1 Aug. 31, 2023

Related U.S. Application Data

(60) Provisional application No. 63/057,562, filed on Jul. 28, 2020.

(51) Int. Cl.

| | |
|---|---|
| ***E21B 17/046*** | (2006.01) |
| ***E21B 7/04*** | (2006.01) |
| ***E21B 19/16*** | (2006.01) |

(52) U.S. Cl.
CPC ..... *E21B 17/0465* (2020.05); *E21B 7/046* (2013.01); *E21B 19/16* (2013.01)

(58) Field of Classification Search
CPC ..... E21B 7/076; E21B 17/04; E21B 17/046
See application file for complete search history.

(56) References Cited

U.S. PATENT DOCUMENTS

| | | | |
|---|---|---|---|
| 6,148,935 | A | 11/2000 | Wentworth et al. |
| 6,810,971 | B1 | 11/2004 | Sved |

(Continued)

FOREIGN PATENT DOCUMENTS

| | | | |
|---|---|---|---|
| DE | 10359880 | A1 | 7/2005 |
| EP | 3587729 | A1 | 1/2020 |
| WO | 00/11303 | A1 | 3/2000 |

OTHER PUBLICATIONS

International Search Report and Written Opinion for Related Application No. PCT/US2021/042435 dated Sep. 13, 2021 (13 pages).

(Continued)

*Primary Examiner* — Kristyn A Hall
(74) *Attorney, Agent, or Firm* — Michael Best & Friedrich LLP

(57) ABSTRACT

A drill string joint includes a box end member defining, at a first axial end thereof, a first bore and a second deeper bore of smaller cross section than the first bore. A pin end member defines a first insertion portion corresponding to the first bore and a second insertion portion corresponding to the second bore. A conical tapered surface interface is defined between the second insertion portion and the second bore. Cross pins extend through apertures formed through the box end member, at the first bore, and the first insertion portion, within an axial span of the joint separate from an axial span in which the conical tapered surface interface of the second insertion portion and the second bore is defined. A torque coupling is established between the box end member and the pin end member at an axial position between the separate axial spans.

31 Claims, 16 Drawing Sheets

(56) References Cited

U.S. PATENT DOCUMENTS

| | | | |
|---|---|---|---|
| 6,860,514 | B2 | 3/2005 | Wentworth et al. |
| 8,225,885 | B2 | 7/2012 | Wentworth et al. |
| 9,206,851 | B2 | 12/2015 | Slaughter, Jr. et al. |
| 9,834,995 | B2 | 12/2017 | Slaughter, Jr. et al. |
| 2013/0084131 | A1 | 4/2013 | Langenfeld et al. |
| 2014/0050522 | A1 | 2/2014 | Slaughter, Jr. et al. |
| 2014/0251694 | A1 | 9/2014 | Crane |
| 2016/0084016 | A1 | 3/2016 | Slaughter, Jr. et al. |
| 2018/0148985 | A1 | 5/2018 | Slaughter, Jr. et al. |
| 2020/0040668 | A1* | 2/2020 | Slaughter, Jr. ..... E21B 7/046 |

OTHER PUBLICATIONS

Extended European Search Report for Application No. 24160055.0 dated Apr. 18, 2024 (7 pages).

* cited by examiner

DRILL STRING JOINT FOR HORIZONTAL DIRECTIONAL DRILLING SYSTEM

CROSS-REFERENCE TO RELATED APPLICATIONS

This application claims the benefit of priority to U.S. Provisional Patent Application No. 63/057,562, filed Jul. 28, 2020, the entire contents of which are incorporated by reference herein.

BACKGROUND

The invention relates to horizontal directional drilling (HDD) systems that include a series of drill rods joined end to end to form a drill string that is propelled though the ground by means of powerful hydraulic systems on a HDD machine, having the capacity to rotate while simultaneously pushing or pulling the drill string, as discussed in U.S. Pat. No. 6,766,869, among numerous others. A spade, bit or head configured for boring is disposed at the end of the drill string and may include an ejection nozzle for water or mud to assist in boring. In order to enable steering of the drill underground the drill head has an asymmetric element that deflects the direction of the bore when it is propelled forward in one way, while the direction of the bore is not deflected when it is propelled forward in a different way. For instance, one common drill head incudes a flat plate bit that cuts a straight, undeflected, bore hole when it is propelled forward while at the same time it is rotated. It cuts a deflected bore hole when it is propelled forward without being rotated. While cutting a deflected bore hole the components of the drill head deflect to accommodate the deflected bore path, the components are thus subjected to bending loads. To control the direction, tool location information is tracked by a sonde attached to the cutting tool, the sonde including a sensor and transmitting device.

During forward operation of the drill string by the HDD system, the drill head and sonde housing are attached to the front end of a drill string by a starter rod that includes a joint to which the sonde housing connects while the HDD machine pushes the drill string. Following emergence of the drill head at a terminal end of the drilling operation, the sonde housing is decoupled from the starter rod so that a back reamer can be connected to that joint and then the hole can be enlarged by a reamer as the HDD machine pulls the drill string back in the opposite direction. Some early solutions for this joint include a large slip-on torque collar specially adapted to carry torque loads between two threaded members of the joint, both of which have external hex portions that fit within a hex bore of the torque collar as is described in US 20130084131. The torque collar isolates the threaded joint from torque so that the threads effectively transfer only longitudinal pushing/pulling forces in the drill string. However, in attempts to obviate the assembly/disassembly requirements of extra collars, more recent designs include various versions of "collar-less" couplings, in which there is no extra collar component that slips over the joining drill string elements to carry the torque. Rather, as shown in EP3587729A1, drill string members may be connected for torque transmission by a spline structure while longitudinal forces are borne by pins that extend through mated portions of the drill string members adjacent the spline structure. Although collar-less joint designs have shown some limited efficacy, the durability and expected life span of such joints trails collared designs substantially when subjected to the combined effects of axial force, torque, and bending loads experienced during real world operation of a HDD drill string, or in laboratory testing simulating the same. Thus, a need exists for a more durable, yet simple, drill string connection joint.

SUMMARY

In one aspect, the invention provides a drill string joint for joining a drill head to a drill string along a central axis, the joint including a box end member defining, at a first axial end thereof, a first bore and a second deeper bore of smaller cross section than the first bore. A pin end member defines a first insertion portion corresponding to the first bore and a second insertion portion corresponding to the second bore. A conical tapered surface interface is defined between the second insertion portion and the second bore. A plurality of cross pins extends through corresponding apertures formed through both the box end member, at the first bore, and the first insertion portion of the pin end member, the plurality of cross pins located within a first axial span of the joint separate from a second axial span in which the conical tapered surface interface of the second insertion portion and the second bore is defined. A torque coupling is established between the box end member and the pin end member at an axial position between the first axial span and the second axial span.

In another aspect, the invention provides a method of assembling a drill string joint, including a drill head, along a central axis. A pin end member is inserted into a box end member along the central axis such that a first insertion portion of the pin end member is positioned within a first bore of the box end member at a first axial end of the box end member, and a second insertion portion of the pin end member is positioned within a second deeper bore of the box end member, the second bore having a smaller cross section than the first bore. A conical tapered surface interface is established between the second insertion portion and the second bore with the axial insertion of the pin end member to the box end member. A torque coupling is established with the axial insertion of the pin end member to the box end member. A plurality of cross pins are inserted perpendicular to the central axis through corresponding apertures formed through both the box end member, at the first bore, and the first insertion portion of the pin end member, the plurality of cross pins being located within a first axial span of the joint separate from a second axial span in which the conical tapered surface interface is established. The torque coupling is established at an axial position between the first axial span and the second axial span.

In yet another aspect, the invention provides a drill string coupler for establishing a joint between drill string components at a head end of a drill string of a horizontal directional drilling system. A first coupling portion of the coupler is adapted for insertion into a first bore along a central axial direction. A second coupling portion of the coupler has a conical tapered surface adapted for insertion into a second bore smaller than the first bore. The second coupling portion is provided along an axial span that is offset from an axial span of the first coupling portion. A plurality of cross apertures is formed through the first coupling portion to receive a corresponding plurality of cross pins. A torque connection structure is provided at an axial position between the respective axial spans of the first and second connection portions.

DETAILED DESCRIPTION

Before any embodiments of the present invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
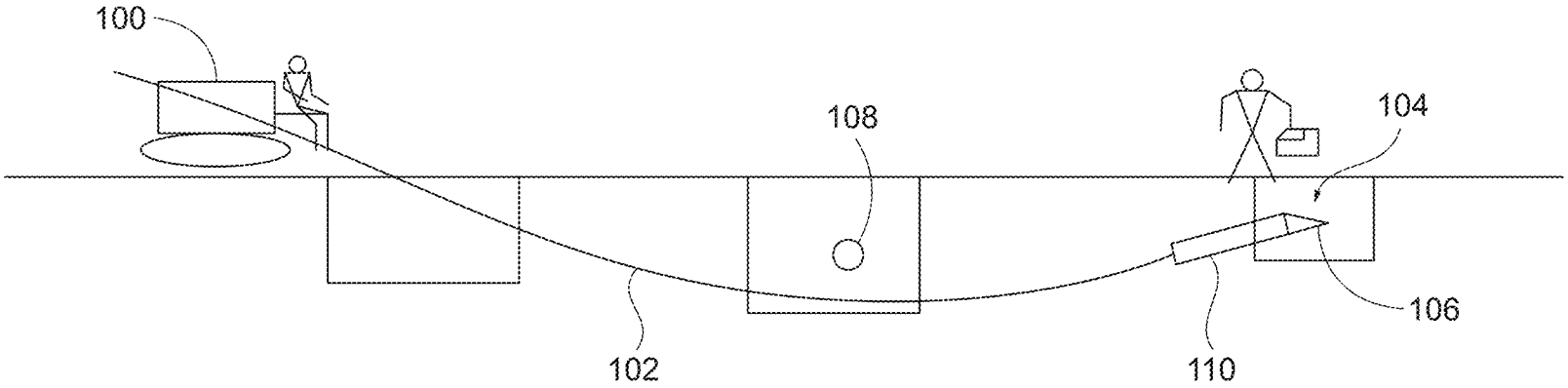
FIG. 1 is a schematic view of a horizontal directional drilling operation.

FIG. 1 illustrates a basic system for horizontal directional drilling (HDD), including a HDD machine 100 operable to perform trenchless, directional-controlled underground drilling between two points, e.g., for utility installations, such as gas lines. A plurality of drill rod assemblies are sequentially connected end-to-end on the HDD machine 100 to form a drill string 102. The drill string 102 is driven into the ground by the HDD machine 100. At the end of the drill string 102 is a drill head 104 having a rotating drilling tool or drill bit 106. The drill head 104 can also include a sonde housing 110 in which electronics (e.g., gyroscopic sensor(s), a data relay receiver, a beacon, a steering mechanism) are provided for tracking and/or steering the drill head 104 underground. For example, the drill head 104 may be steered around or under an underground obstruction 108, e.g., a pre-existing sewer line or other utility installation, from above ground using information provided from the electronics in the sonde housing 110. The HDD machine 100 includes a plurality of mechanical systems operable to assemble and disassemble a drill string 102 and operable to plunge and retract the drill string 102 into and out of the ground in a direction that is at least partially horizontal with respect to the ground.

Figure 2:
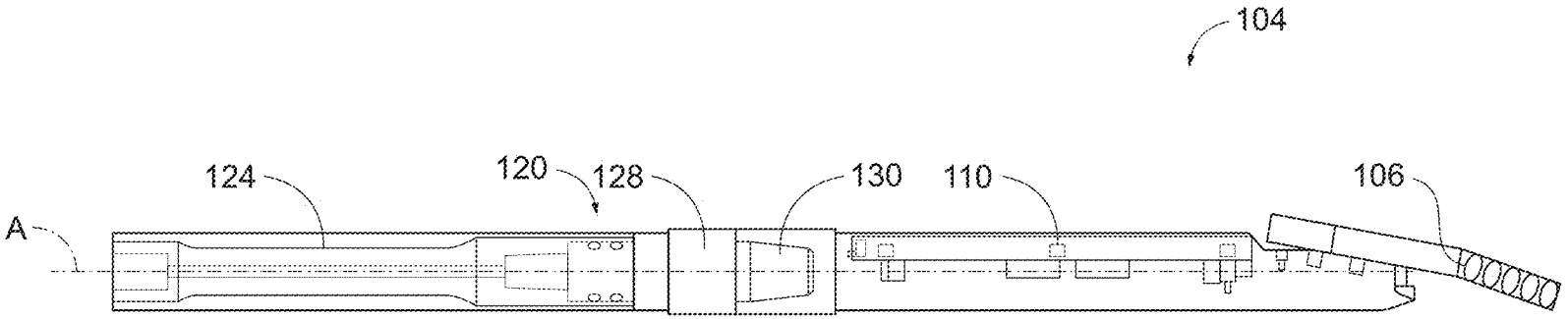
FIG. 2 is a side elevation view of a HDD drill head coupled with a drill string starter rod by a collar-less joint, according to one embodiment of the present disclosure.
Figure 2A:
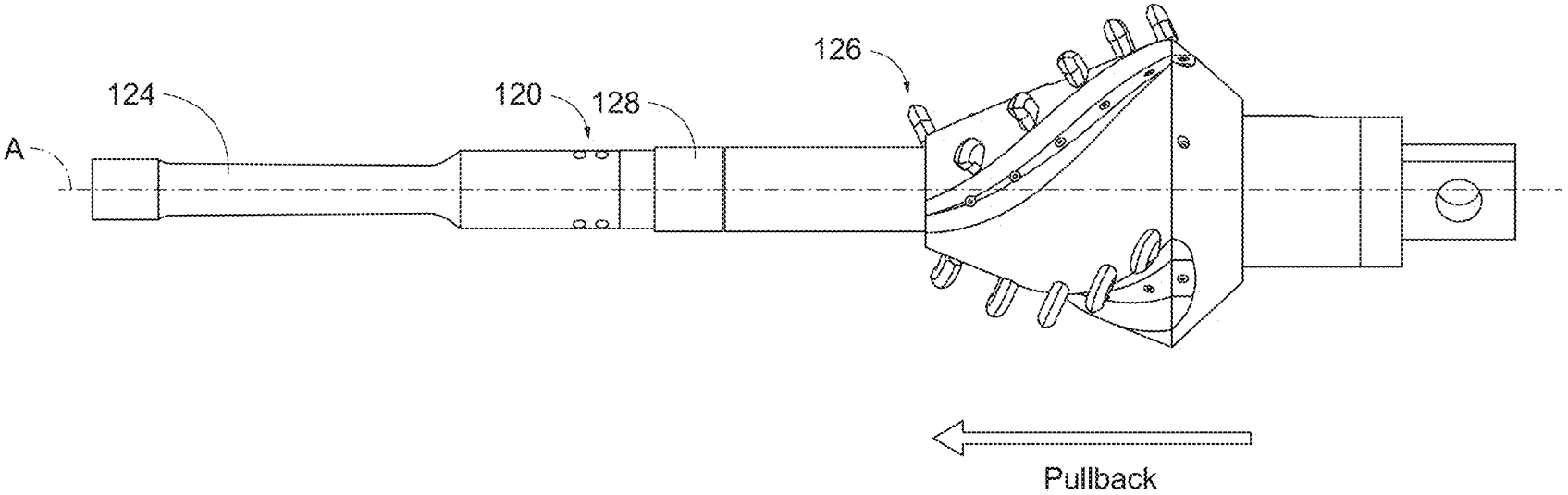
FIG. 2A is a side elevation view of the collar-less joint of FIG. 2 with a HDD reamer coupled to the drill string rather than the drill head.

As shown in FIG. 2, an improved drill string joint 120 is provided for joining drill string components along an axis A. The drill string joint 120 can be provided, for example between the drill head 104 and a starter rod 124. FIG. 2A illustrates the same joint 120 where the drill head 104 is removed and replaced with a reamer 126. Numerous drill rods, generally of uniform construction different than the starter rod 124, are provided behind the starter rod 124 to sequentially build up the length of the drill string 102. In order to connect the starter rod 124 with the sonde housing 110, the joint 120 includes an interstitial coupler 128, which may be referred to as an adapter. The interstitial coupler 128 can have a first end (FIG. 2, right) with a connection structure, for example by mating threads, securely coupled with the sonde housing 110. In the illustrated construction, the coupler 128 has a tapered male thread portion 130 that fits within a female thread portion of the sonde housing 110. However, it should be appreciated that other means of connection to the sonde housing 110 are optional, and that features at the second end (FIG. 2, left) of the interstitial coupler 128 can be provided on the sonde housing 110 as an integral part thereof. Further still, the drill string joint 120 may be used for other couplings besides those between the sonde housing 110 and the starter rod 124. In generalized terms, the starter rod 124 serves as a box-end member of the joint 120, and the coupler 128 serves as a complementary, mating pin-end member of the joint 120. Thus, in the following description of the starter rod 124 and the coupler 128, it should be appreciated that features of these members are provided in order to achieve a specific joint construction between a box-end member and a pin-end member and they are not necessarily dependent in all constructions on being incorporated in a starter rod and coupler, per se. Beyond FIG. 2, the discussion focuses on the detailed construction of the joint 120.

Figure 3:
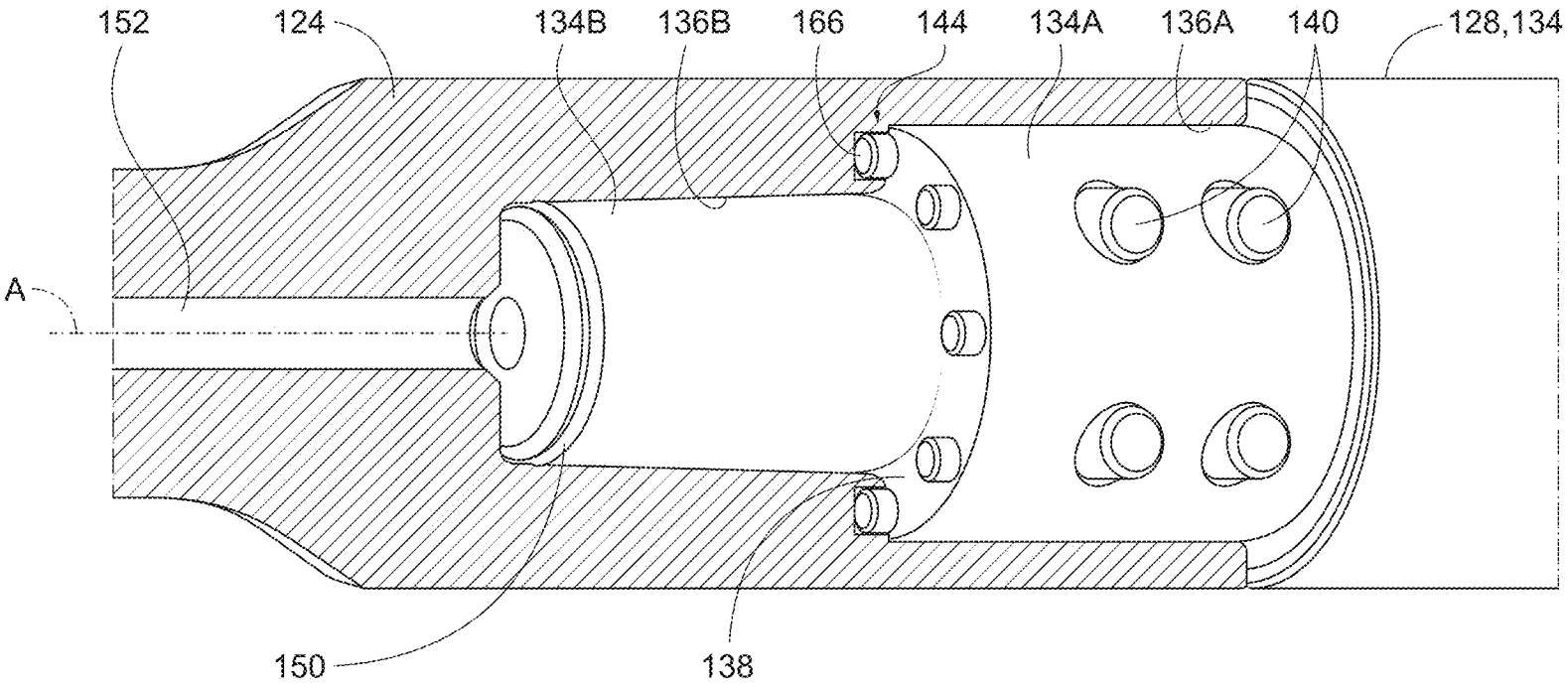
FIG. 3 is a perspective partial section view of the joint of FIG. 2 where a portion of the drill string starter rod is cut away.
Figure 5:
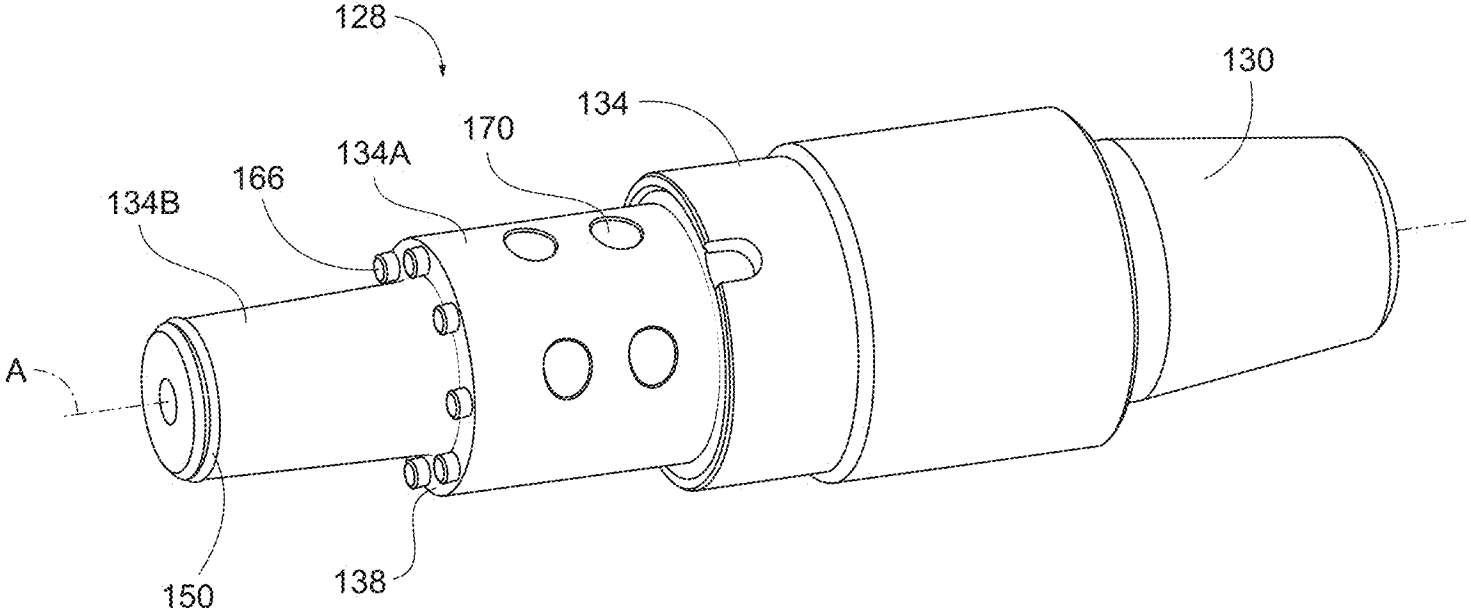
FIG. 5 is a perspective view of an adapter or coupler used in the joint of FIGS. 2-3.
Figure 6:
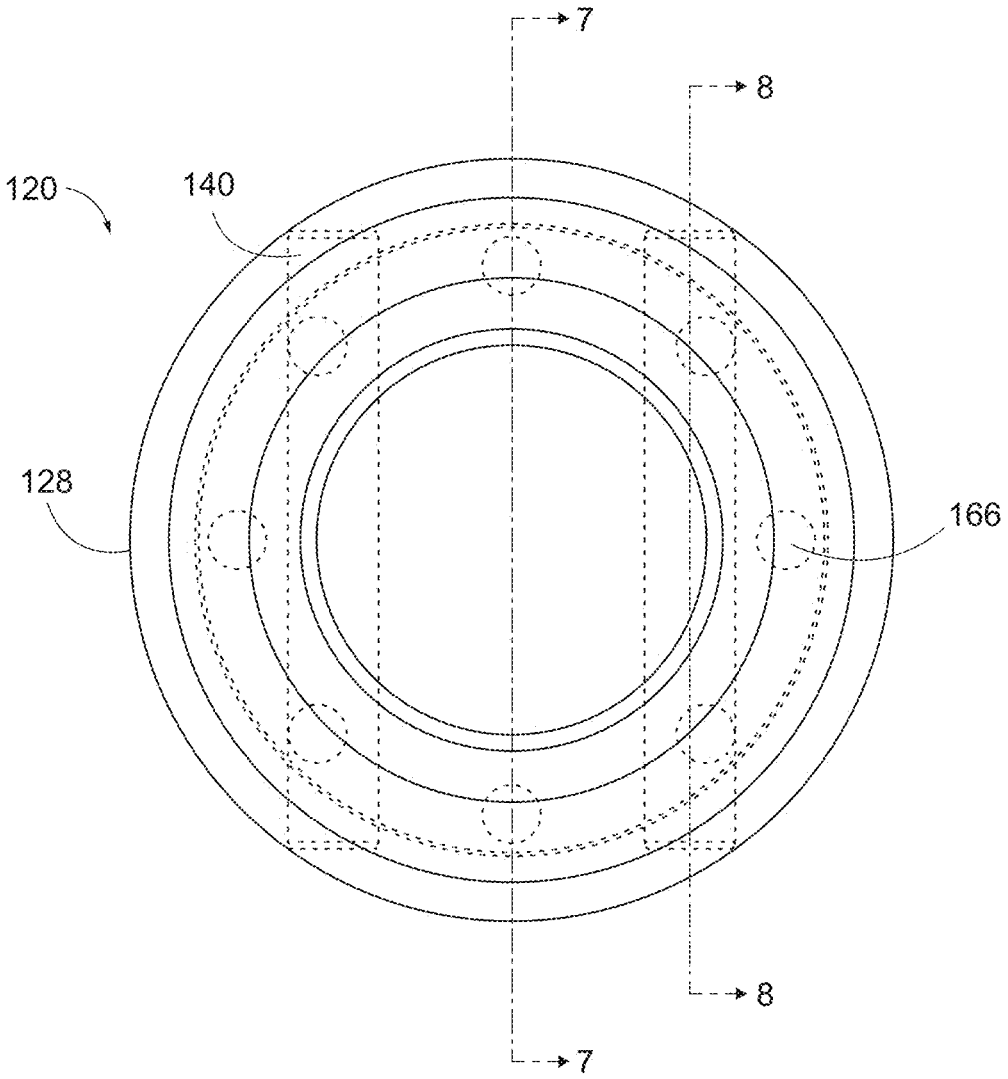
FIG. 6 an end view of the joint of FIGS. 2 and 3.

As will become apparent from the further description below, the joint 120 is specifically constructed as a collar-less joint that provides drastic improvements in durability by divorcing from each other the sections of the coupling responsible for handling the bending loads and the longitudinal or axial push/pull loads, respectively. As a general introduction to the features described below, FIG. 3 illustrates how the coupler 128 is constructed with a first section 134 of relatively larger diameter (e.g., equal to an outer diameter of the starter rod 124 at the mating end), a first reduced-diameter section 134A and a further-reduced-diameter section 134B. As better shown in FIG. 5, the first section 134 of the coupler 128 can in some constructions include portions of separate diameter, e.g., one portion generally matching the outer diameter of the starter rod 124 and one portion generally matching the outer diameter of the distal end component (sonde housing 110 or reamer 126) coupled at the other end of the coupler 128. The first reduced-diameter section 134A defines a first insertion portion that is received within a first bore 136A of the starter rod 124, while the further-reduced-diameter section 134B defines a second insertion portion received within a second bore 136B of the starter rod 124. The two reduced-diameter sections 134A, 134B are out-of-line with each other or offset, such that there is no overlap axially therebetween. A shoulder surface 138 is defined between the two reduced-diameter sections 134A, 134B, or said another way the shoulder surface 138 is provided at the distal end of the first reduced-diameter section 134A. As illustrated, the shoulder surface 138 extends perpendicular to the axis A such that there is minimal or no axial spacing distance between the two reduced-diameter sections 134A, 134B, although an axial spacing may be provided therebetween.

The first reduced-diameter section 134A and the first bore 136A define a first joint section responsible for carrying all the longitudinal, or particularly axial pullback loads, imparted during reaming or pullback operations of the horizontal directional drilling system. For example, all the forward drilling loads (i.e., drill string compression during pilot hole formation) between the starter rod 124 and the coupler 128 can be carried by the shoulder surface 138, which bears against another shoulder surface 160 (FIG. 4A) on the starter rod 124. Meanwhile, all the pullback loads (i.e., drill string tension during back reaming) between the starter rod 124 and the coupler 128 can be carried by a series of cross-pins 140 that extend through both the starter rod 124 and the coupler 128 perpendicular to the axis A. The further-reduced-diameter section 134B and the second bore 136B define a second joint section responsible for carrying the bending loads imparted during the horizontal directional drilling operations. A torque coupling 144 for transmitting torque between the starter rod 124 and the coupler 128 (in either direction, depending upon circumstance) is defined at an end of the first reduced-diameter section 134A that is situated adjacent the bottom of the first bore 136A and adjacent the further-reduced-diameter section 134B. Adjacent the bottom end of the second bore 136B, a seal can be made between the starter rod 124 and the coupler 128, for example by an O-ring 150 at the distal end of the further-reduced-diameter section, or "nose" portion 134B of the coupler 128. Alternately or in addition, a seal can be established at the open end of the first bore 136A or along the first reduced-diameter section 134A. An engagement length LB of the nose portion 134B can refer to the axial length of contact with the second bore 136B, either with or without the seal 150.

Figure 4:
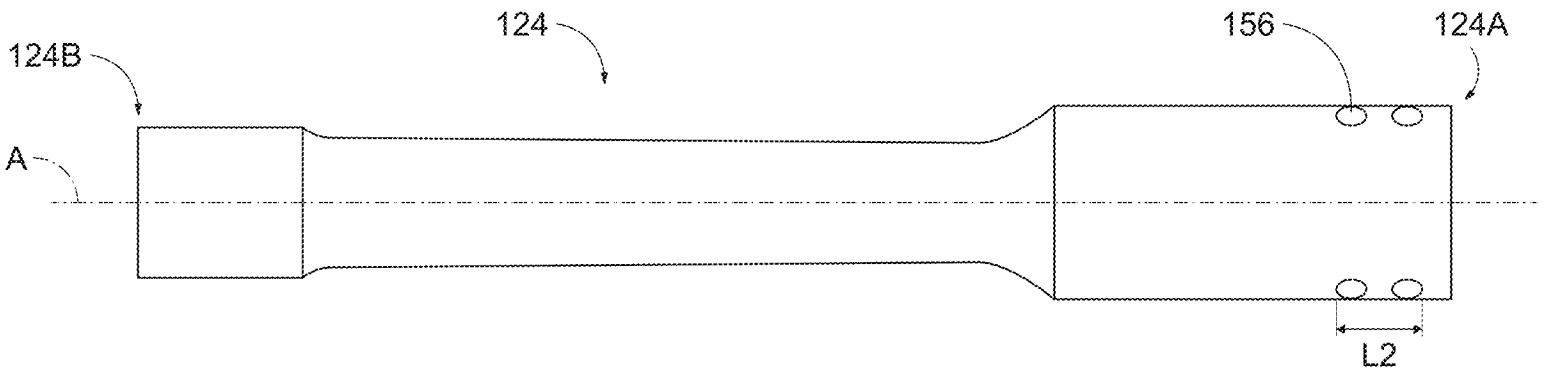
FIG. 4 is a side elevation view of the drill string starter rod for use in making the joint of FIGS. 2-3.
Figure 4A:
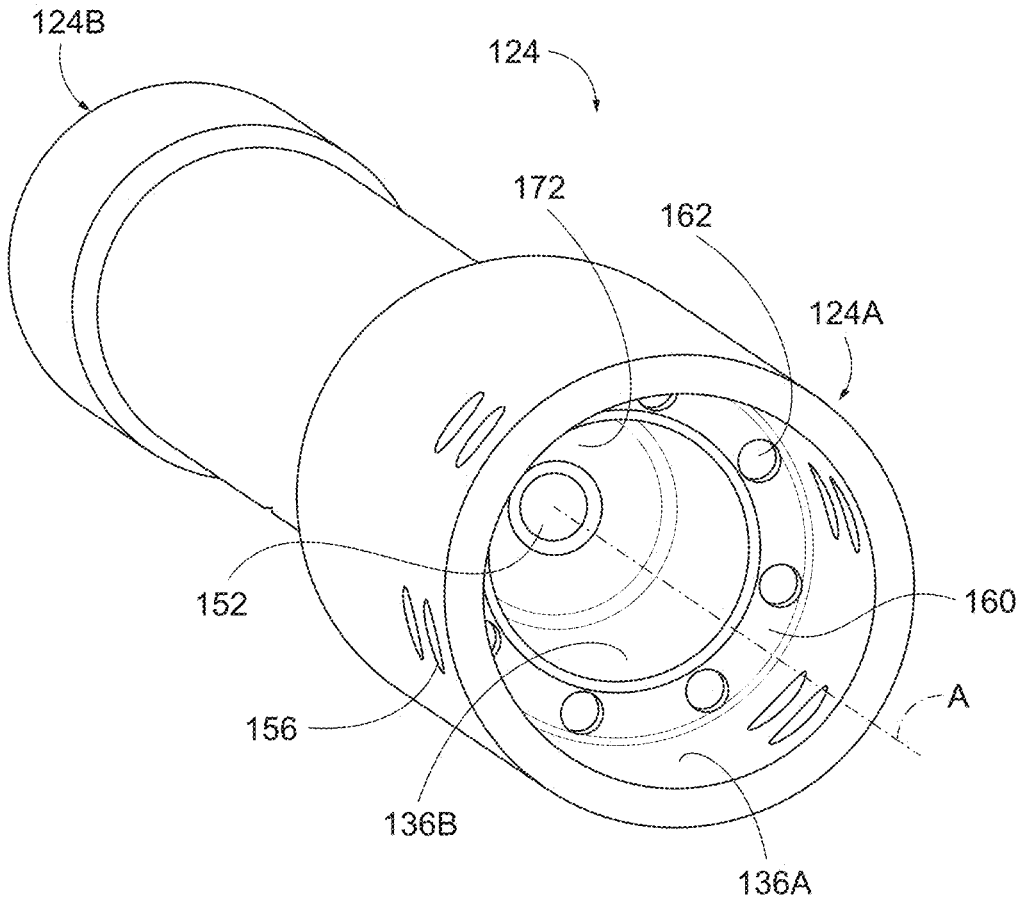
FIG. 4A is a perspective view looking into the drill head-facing end of the drill string starter rod.

Turning briefly to the construction of the starter rod 124 as shown by itself in FIGS. 4 and 4A, it will be seen that the first end 124A of the starter rod 124 defining the first bore 136A can have an outside surface that serves as a largest outer diameter portion of the starter rod 124 along its axial length. The majority of the length of the starter rod 124 has a uniform minimum outer diameter that is less than the outer diameter adjacent the first end 124A and less than an outer diameter adjacent a second opposite end 124B. However, the diameter at the second end 124B is based on the particular connection size selected. Along the center of the starter rod 124, an axial through bore 152 is provided (FIGS. 3 and 4A), rendering the starter rod hollow, e.g., for passage of drilling fluid during operation. As best shown in FIG. 4A, the wall section bounding the first bore 136A and providing the large outer diameter periphery of the starter rod 124 is provided with a plurality of cross apertures 156 that are provided in pairs for respectively receiving the opposing ends of the respective cross-pins 140 for establishing the axial (pull) connection of the joint 120. Beyond the first bore 136A, the second bore 136B extends with a tapered profile such that the second bore 136B has a conical shape complementary to a conical outer surface shape of the nose portion 134B of the coupler 128. The second bore 136B extends to a depth approximately equal to a depth of the first bore 136A, and both bores 136A, 136B reside entirely within the large outer diameter portion of the starter rod 124 as shown in FIG. 3.

As shown in FIG. 4A, the transition between the first and second bores 136A, 136B occurs at or defines a shoulder surface 160 at which the torque-coupling 144 is provided. The shoulder surface 160 can be a ring-shaped surface lying in a plane perpendicular to the axis A and positioned at the respective ends of the first and second bores 136A, 136B. A circumferential array of torque-transmitting structures 162 are provided around the shoulder surface 160. As shown, the structures 162 are blind bores of circular cross-section, although other shapes or constructions are optional. The blind bores 162 receive respective torque pins 166 that are also fixed with the coupler 128 as described further below. In some constructions, there are more than four torque pins 166, e.g., at least 6, at least 7, or at least 8 torque pins 166. The torque pins 166, along with the corresponding bores 162, are equally spaced along the circumferential direction about the axis A. Each of the torque pins 166 can be press fit to one of the starter rod 124 or the coupler 128. In one exemplary construction, all the torque pins 166 are press fit to respective bores 168 (FIG. 9) in the shoulder surface 138 of the coupler 128 that faces the shoulder surface 160 at the bottom of the first bore 136A. Thus, all the torque pins 166 remain with the coupler 128 when the joint 120 is disassembled. When the joint 120 is assembled, the coupler 128 may or may not contact the shoulder surface 160, depending upon the presence of axial load, but the torque pins 166 establish a torque transmitting connection with little or no rotational slack or backlash. The length of the torque pins 166 is selected so that they are short enough to avoid exposure to bending load and long enough that there is adequate surface area to avoid premature wear in the blind holes 162 on the starter rod 124.

Figure 7:
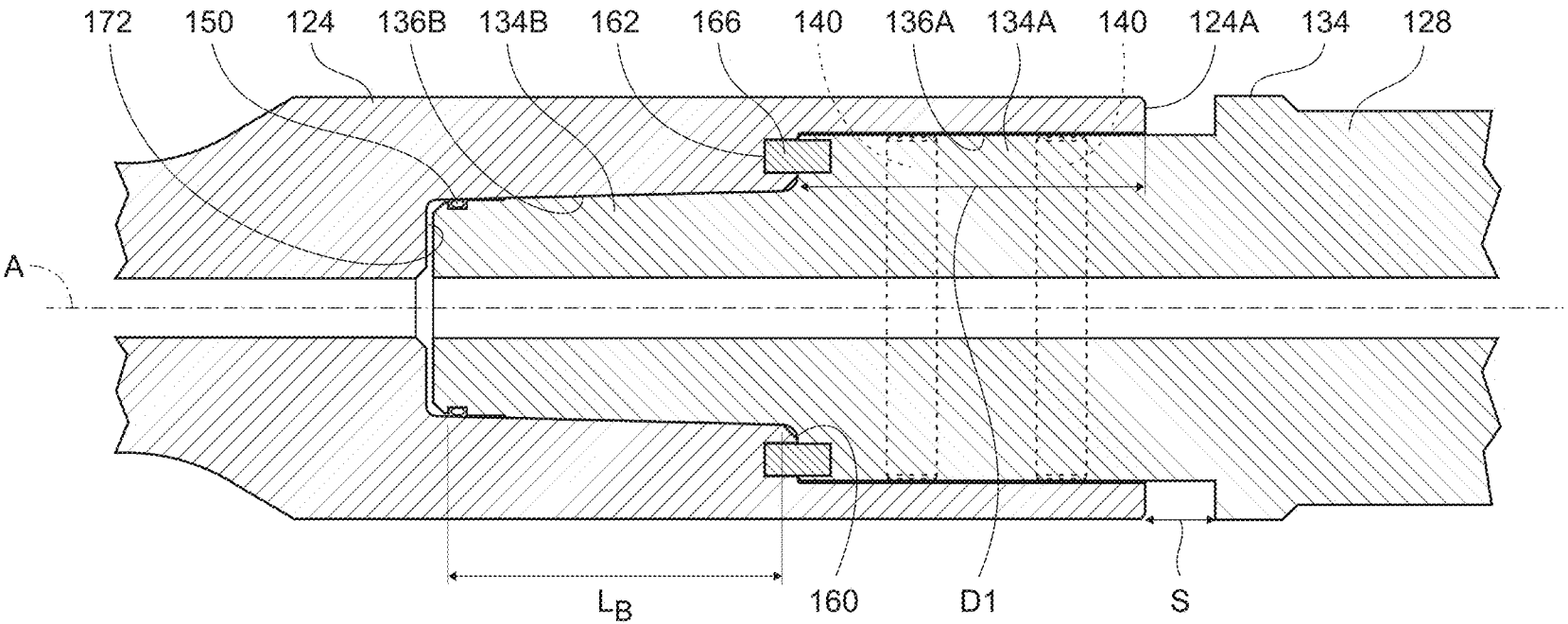
FIG. 7 is a cross-section view of the joint, taken along line 7-7 of FIG. 6, which intersects a central axis of the drill string.
Figure 8:
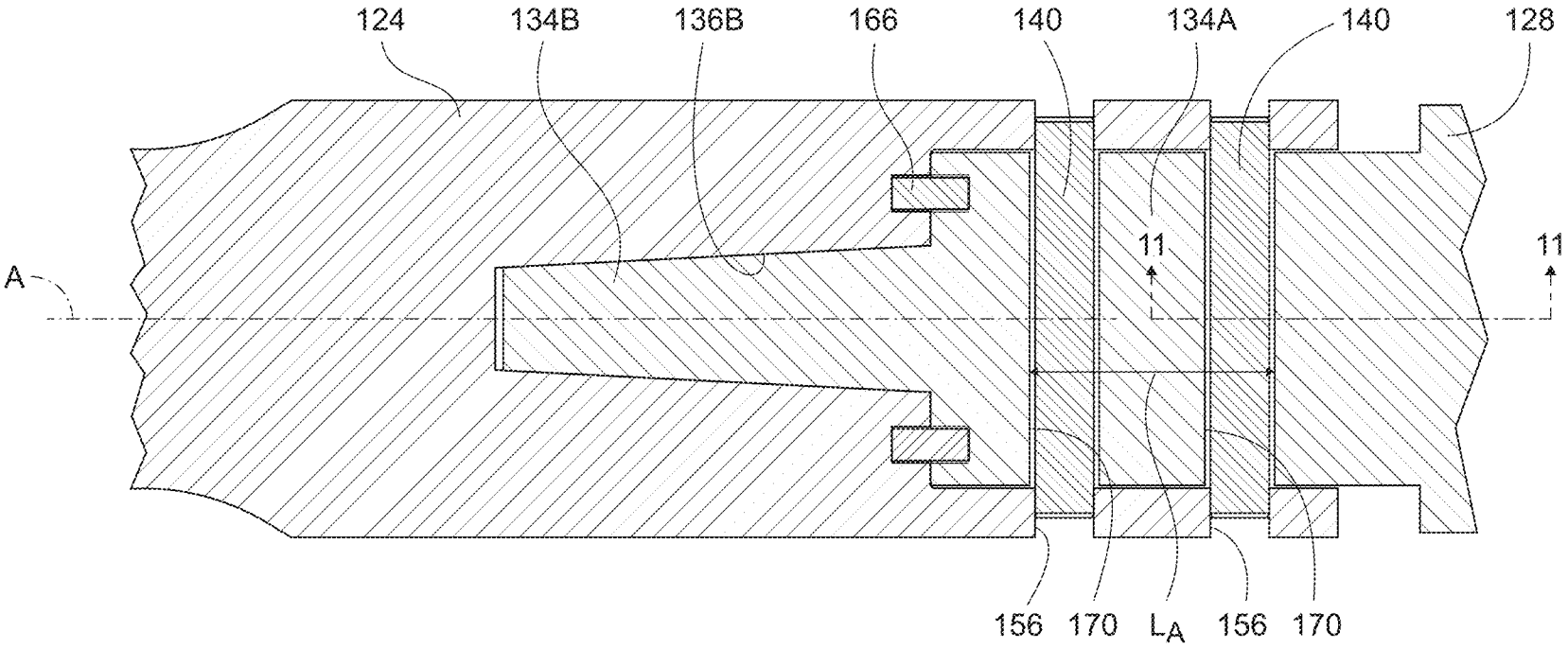
FIG. 8 is a cross-section view of the joint, taken along line 8-8 of FIG. 6, which is offset from the central axis of the drill string to cut through a connection pin.
Figure 9:
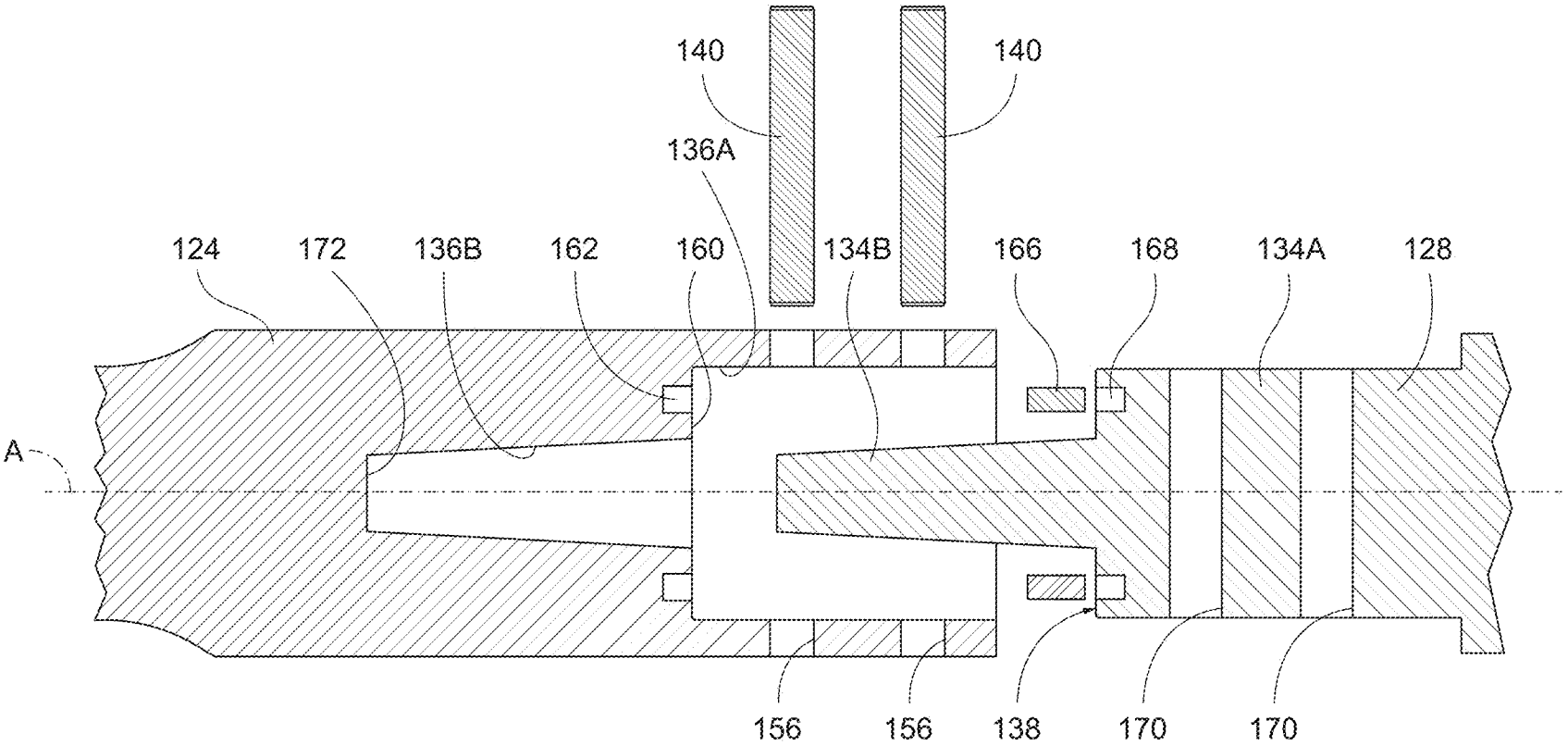
FIG. 9 is a cross-section view of the joint, similar to FIG. 8, showing the various parts exploded rather than assembled.
Figure 11:
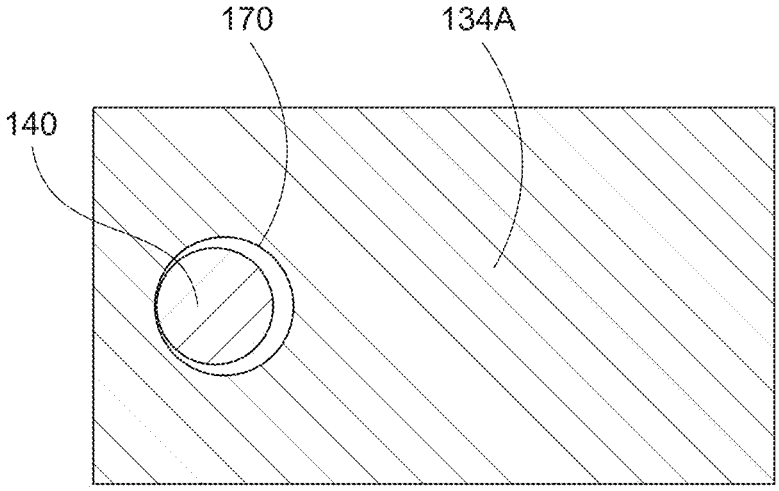
FIG. 11 is a cross-section view of the joint, taken along line 11-11 of FIG. 8, to better illustrate a clearance between a cross pin and a bore within the first insertion portion of the coupler.
Figure 11A:
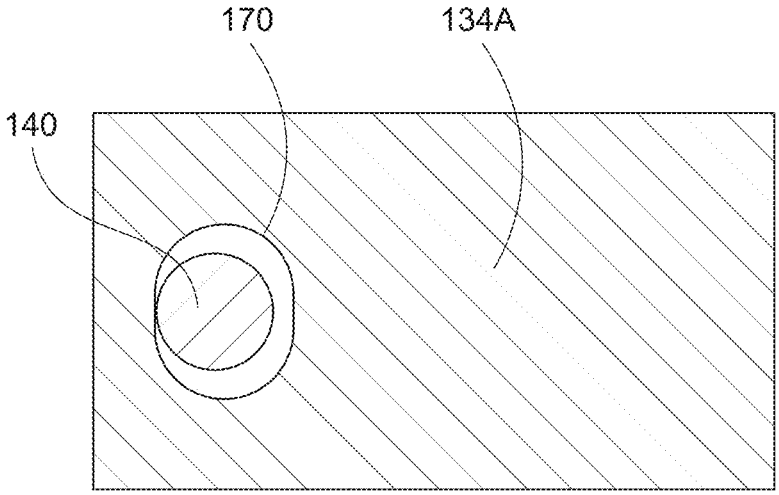
FIG. 11A is a cross-section view similar to FIG. 11, but illustrating an alternate embodiment in which the bore within the first insertion portion is elongated circumferentially.

Turning to FIGS. 8 and 9, it can be seen that the cross pins 140 extend through corresponding apertures 170 in the coupler portion 134A, which apertures 170 are aligned with corresponding ones of the apertures 156. Despite the substantial length LB (e.g., equal to or greater than the depth D1 of the first bore 136A, FIG. 7), the nose portion 134B does not bottom out in the second bore 136B, instead remaining spaced from a bottom end 172 of the second bore 136B, ensuring that the apertures 170 can be put into alignment with the corresponding apertures 156 for assembly of the cross pins 140. Similarly, a space S may be left between the starter rod first end 124A and the first (large OD) section 134 of the coupler 128 as shown in FIG. 7. Clearance between the apertures 170 and the outer diameter of the cross pins 140 (FIGS. 8 and 11), along with the substantial span of the nose portion 134B and the tight-fitting torque pins 166, isolates the cross pins 140 and the corresponding sections of the starter rod 124 and the coupler 128 from being exposed to torque or bending loads of the drill string. This especially increases the long-term durability of the starter rod wall section having the cross apertures 156. The cross pins 140 can be tight fitting, for example defining an interference fit, with the cross apertures 156 of the starter rod 124. The clearance between the cross pins 140 and the apertures 170 through the coupler 128 can be provided by simply oversizing the aperture 170 (e.g., circular) as shown in FIG. 11. An exemplary diametrical clearance here may be 0.020 inch to 0.060 inch. Alternately, as shown in the alternate embodiment of FIG. 11A, the apertures 170 may be circumferentially elongated (e.g., in addition to having an axially-measured diametrical clearance), providing them with a non-circular cross-section. The circumferential elongation can be 0.008 inch, or even substantially larger. Both FIGS. 11 and 11A illustrate the cross pins 140 in a position within the aperture 170 that may be occupied during times of drill string tension (e.g., pullback). Although there may be particular advantage with providing the cross pins 140 with clearance on the apertures 170 and tight fit with the apertures 156, it is contemplated that this may also be reversed.

Figure 10:
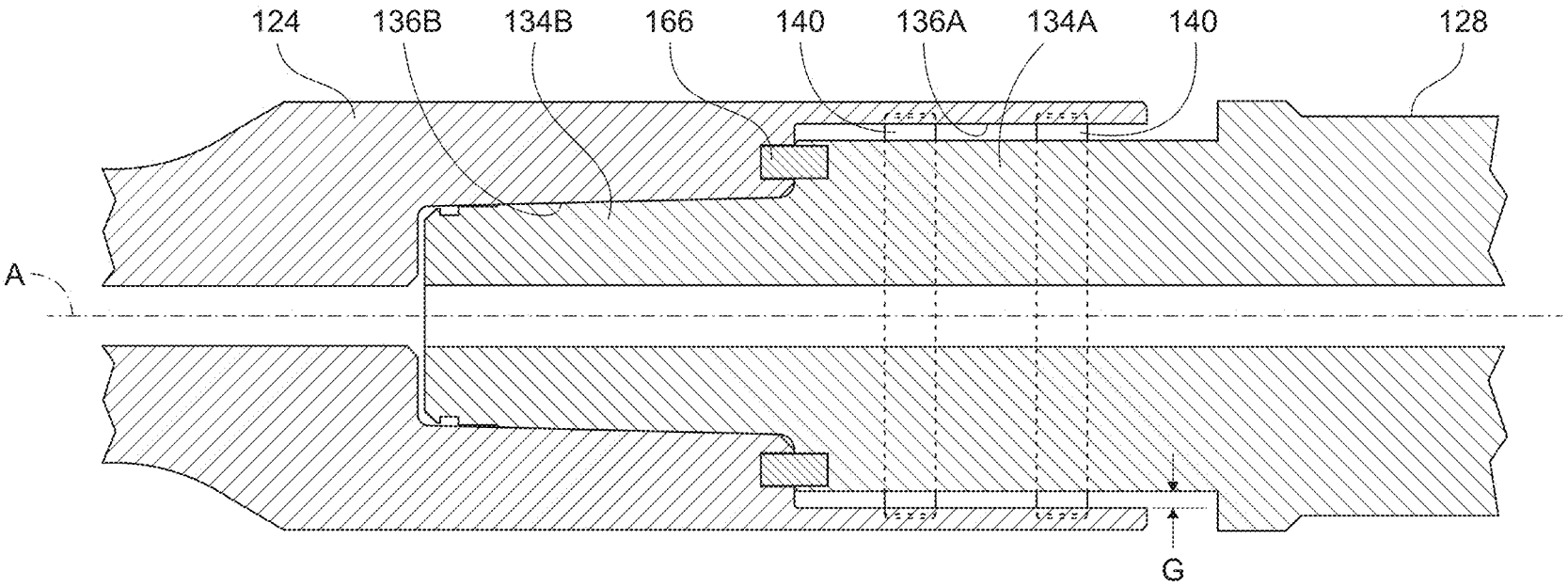
FIG. 10 is a cross-section view of the joint, similar to FIG. 7, showing an exaggerated clearance between a first insertion portion of the coupler and a first receiving bore of the starter rod.

Although the mating surfaces of the second bore 136B and the nose portion 134B are tapered (e.g., draft angle of 5 degrees or less) and tight fitting, there is no such relationship between the outside surface of the first insertion section 134A of the coupler 120 and the directly adjacent inner surface of the first bore 136A. Each of these surfaces can be cylindrical in shape such that the surface extends parallel to the axis A. Furthermore, the joint 120 is designed with a built-in diametrical clearance between the first bore 136A and the first insertion section 134A. This small diametrical clearance (e.g., greater than 0.010 inch and less than 0.100 inch) is exaggerated in FIG. 10 for illustrative purposes and results in the illustrated radial gap G. In a condition where the first insertion section 134A is centered in the first bore 136A, the diametrical clearance will be two times the radial gap G. In some constructions the diametrical clearance is 0.014 inch to 0.025 inch, or more particularly 0.018 inch to 0.021 inch.

To further characterize the various portions of the joint 120, the nose portion 134B and second bore 136B are engaged along the length LB to bear bending loads in isolation (i.e., little or no torque or axial loads). The span of the engagement length LB is completely separate and spaced from a second axial span LA of the joint 120 in which the cross pins 140 reside (FIG. 8). The second axial span LA is a subset or central range within the depth D1 of the first bore 136A. The cross pins 140 also engage a portion of the coupler 128 that is distinct from the nose portion 134B, i.e., the first insertion section 134A, which has a different outer diameter (and different shape) than the nose portion 134B. As described above, the axial span of the joint 120 in which the cross pins 140 are located is adapted to bear axial pullback loads in isolation (i.e., little or no torque or bending loads). Relatively speaking, the torque coupling 144 is provided axially between the two aforementioned sections of the joint 120 (e.g., at the change in cross-section shape between the coupler sections 134A, 134B), although it is noted that the torque pins 166 define some overlap in the axial direction with both sections 134A, 134B. The torque coupling 144 is generally incapable of bearing axial push/pull loads. Bending loads within the torque coupling 144 are eliminated or limited by the presence of the extended length nose portion 134B, which is provided for this designated purpose. The engagement length LB may exceed an axial length of the torque pins 166 by a substantial margin. For example, the engagement length LB along the nose portion 134B may be at least 3 times or at least 4 times the torque pin length. The engagement length LB may be selected relative to the clearance between the first bore 136A and corresponding first insertion section 134A (i.e., the gap G) and/or the span of the first bore depth D1 where bending is desired to be avoided. For example, engagement length LB may be greater than the depth D1, e.g., with the exemplary clearance ranges stated above.

Figure 12:
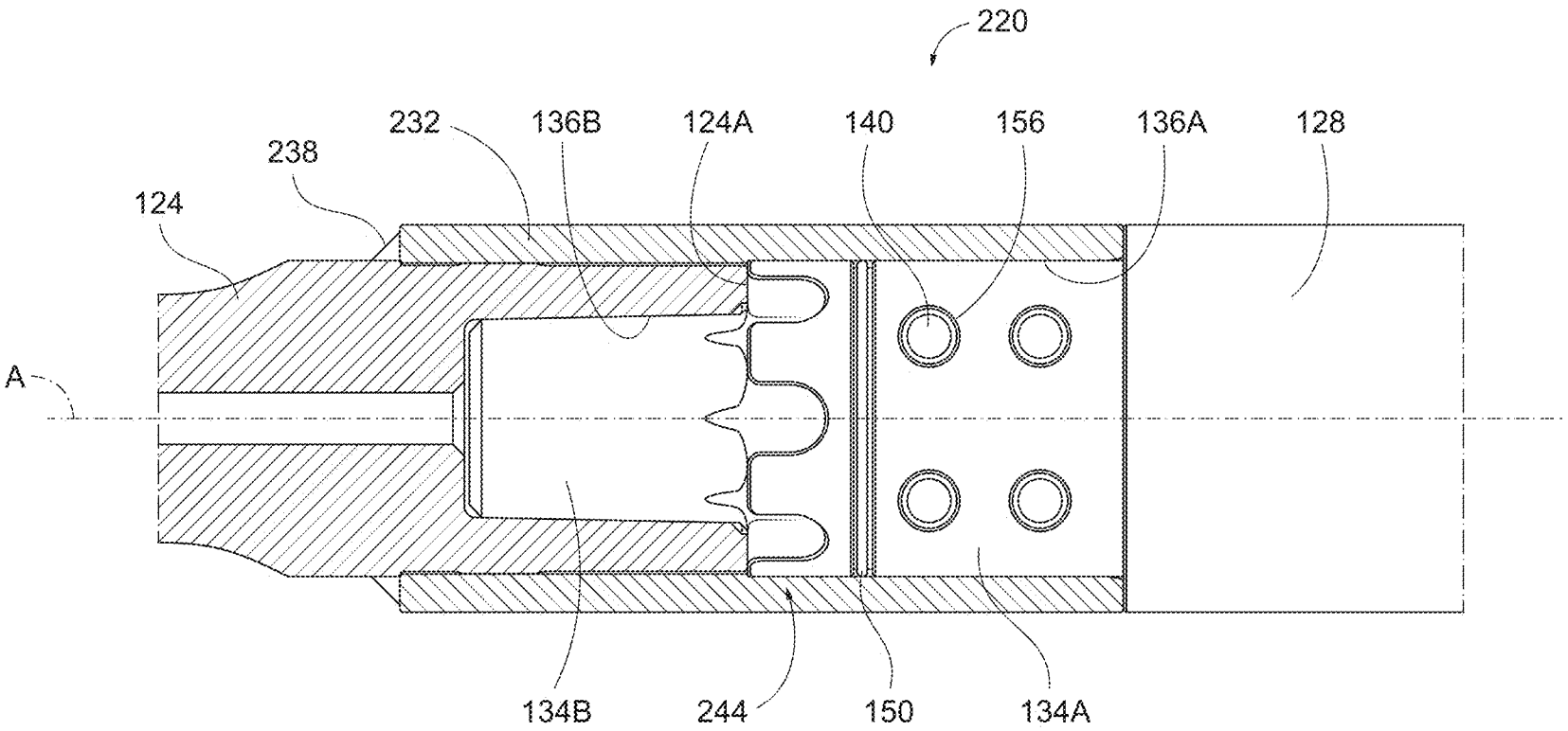
FIG. 12 is a cross-section view of a drill string joint according to another embodiment of the present disclosure.

FIG. 12 illustrates an alternate embodiment for a drill string joint 220 that is similar in most respects to the joint 120, but in which the box end member of the joint is formed by a tube 232 welded or otherwise fixed to the first end of the starter rod 124. In the illustrated construction, the tube 232 is secured to the starter rod 124, which by itself does not form the hollow box end shape for the first insertion section 134A, by a weld bead 238 extending circumferentially partially or fully along an end of the tube 232. Thus, the first bore 136A (with cross apertures 156 therethrough) is formed by the tube 232, which extends axially outward from the first end 124A of the starter rod 124. The second bore 136B that receives the nose portion 134B extends directly to the first end 124A of the starter rod 124, the first end 124A being the exposed distal end up until the time of creating the weldment with the tube 232. The tube 232 can have a smooth, continuous inner cylindrical surface or may have a step formed therein at the axial position of the first end 124A of the starter rod 124. The torque coupling 244 is formed at the first end of the starter rod 124, which corresponds functionally to the shoulder surface 160 of the starter rod 124 in the joint 120. This construction technique allows for machined splines/teeth in the mating joint components 124, 128 for torque carrying purposes, so that they can make the torque coupling 244 directly, without the use of additional torque transmitting components therebetween (e.g., torque pins 166). The toothed profile can be cut into the coupler 128 with an end-mill. A corresponding toothed profile can be cut into the starter rod 124. Subsequent to the machining, the tube 232 is welded on so that the welded assembly becomes the box-end member to render the joint 220 functional in the manner described above with respect to the joint 120. It is also noted that FIG. 12 illustrates an alternate axial location for the O-ring 150, along the first insertion section 134A between the torque coupling 244 and the cross pins 140.

Figure 14:
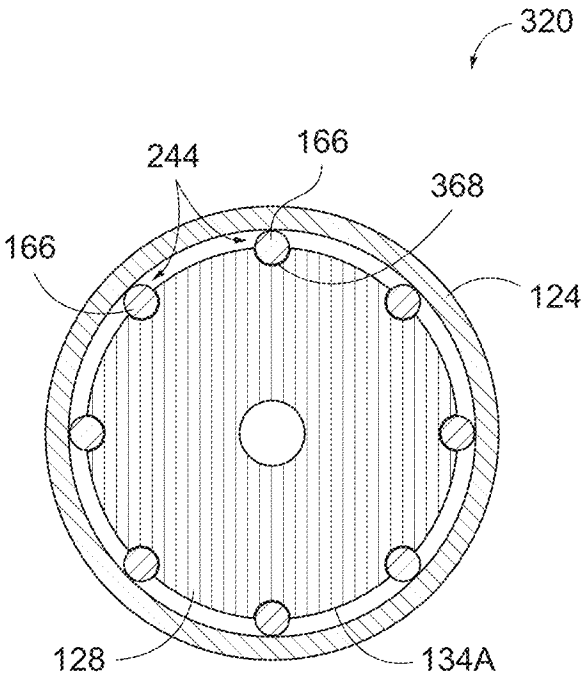
FIG. 14 is a cross-section view of the drill string joint of FIG. 13, taken alone line 14-14.
Figure 13:
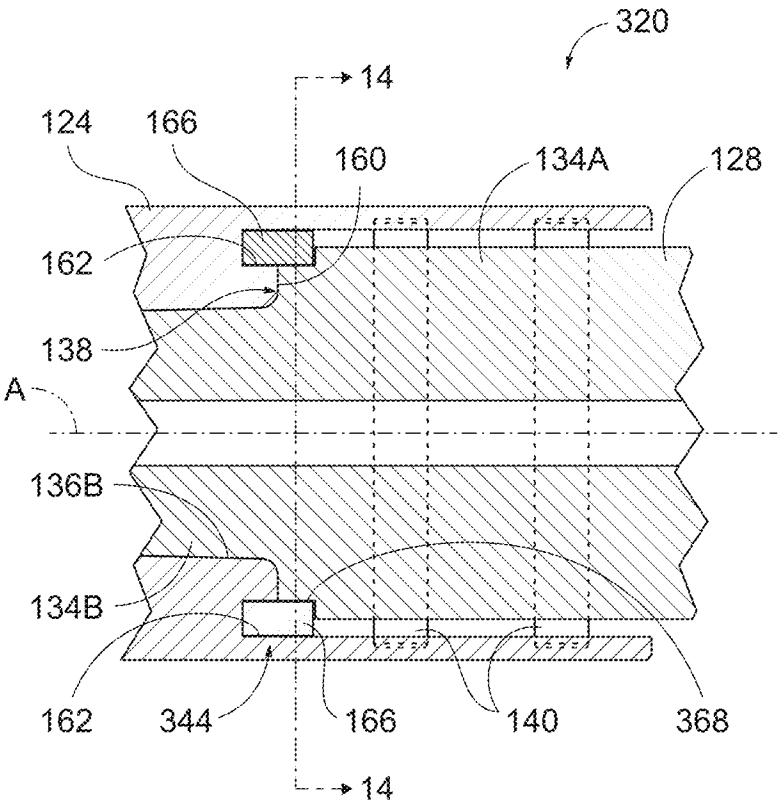
FIG. 13 is a cross-section view, similar to FIG. 7, of a drill string joint according to another embodiment of the present disclosure.

FIGS. 13 and 14 illustrate another alternate embodiment for a drill string joint 320 that is similar in most respects to the joints 120, 220. Thus, reference is made to the preceding description for features not explicitly described below. Differing from the preceding embodiments, the joint 320 has a torque coupling 344 provided at an outer peripheral surface of the first insertion section 134A. The torque coupling 344 remains at the axial location of the shoulder surface 160 of the starter rod 124 and the facing shoulder surface 138 of the coupler 128. Unlike the construction in the joint 120 (see FIG. 7) where the torque pins 166 are entirely inside the outer profile (e.g., diameter) defined by the first insertion section 134A, the torque pins 166 in the joint 320 of FIGS. 13 and 14 are positioned to intersect the outer profile (e.g., diameter) defined by the first insertion section 134A. Some or all of the torque pins 166 are press fit to the respective bores 162 in the shoulder surface 160 at the bottom of the first bore 136A of the starter rod 124. Thus, the torque pins 166 may remain with the starter rod 124 when the joint 320 is disassembled. At the other axial end, the torque pins 166 are received partially in receptacles 368 formed in the outer peripheral surface of the first insertion section 134A of the coupler 128. The receptacles 368 can be troughs or cutouts, open to the radial outer side, rather than receptacles in the form of full-section blind bores as in the preceding joint embodiments.

Figure 16:
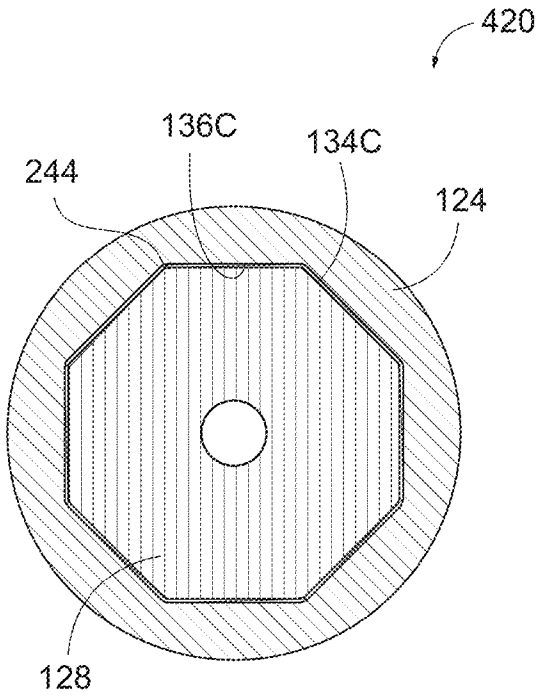
FIG. 16 is a cross-section view of the drill string joint of FIG. 15, taken alone line 16-16.
Figure 15:
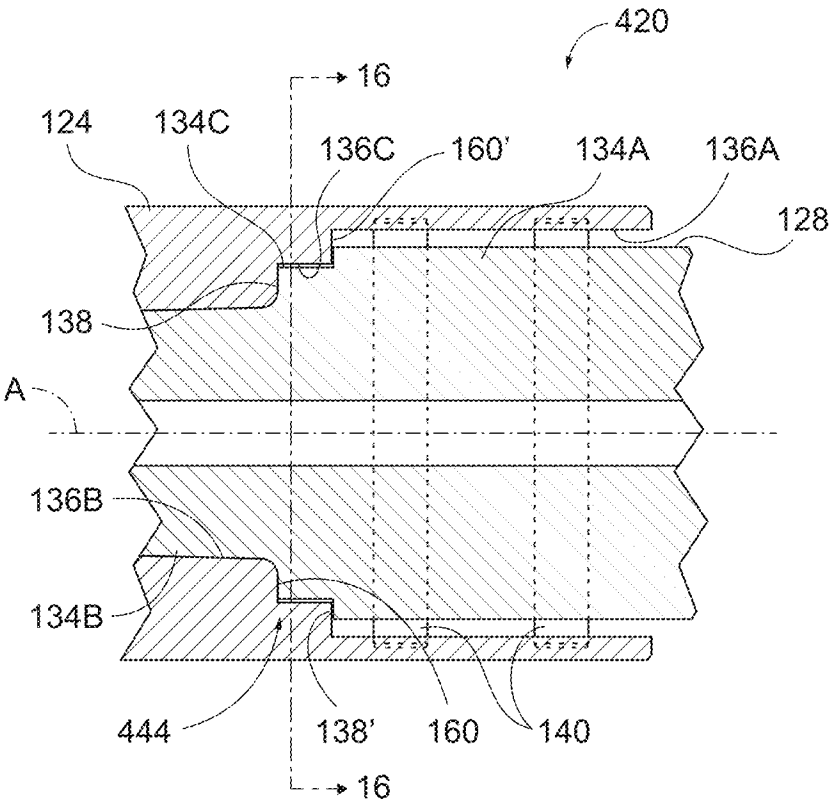
FIG. 15 is a cross-section view, similar to FIG. 7, of a drill string joint according to another embodiment of the present disclosure.

FIGS. 15 and 16 illustrate yet another alternate embodiment for a drill string joint 420 that is similar in most respects to the joints 120, 220, 320. Thus, reference is made to the preceding description for features not explicitly described below. Differing from the preceding embodiments, the joint 420 has a torque coupling 444 provided (e.g., directly) by complementary non-circular or polygonal cross-section profiles of an intermediate insertion section 134C of the coupler 128 and an intermediate bore 136C of the starter rod 124. In the illustrated construction, the intermediate insertion section 134C is a reduced-diameter section smaller than the first insertion portion 134A and larger than the second insertion section 134B. Likewise, the intermediate bore 136C is sized smaller than the first bore 136A and larger than the second bore 136B. In the illustrated construction, the cross-section profiles of the intermediate insertion section 134C and the intermediate bore 136C are octagonal. On this or other non-circular cross-section shapes, the diameter of the profiles making the torque coupling 444 can be taken as the maximum dimension perpendicular to and through the axis A, or the diameter of a reference circle circumscribed through the point(s) farthest from the axis A. Points or surfaces of contact between the intermediate insertion section 134C and the intermediate bore 136C serve as torque connection structures that transmit torque therebetween, even without separate torque transmitting elements (e.g., pins 166).

A radial clearance gap is provided between the intermediate insertion section 134C and the intermediate bore 136C when the intermediate insertion section 134C is centered in the intermediate bore 136C. Thus, a tight fit, which would promote the carrying of bending loads, is avoided, and the torque coupling 444 operates to carry torque loads in isolation (i.e., little or no bending or axial loads). The shoulder surface 138 facing the shoulder surface 160 of the starter rod 124 (and abutting to transmit axial drilling loads) is formed by the axial end surface of the intermediate insertion section 134C rather than the axial end surface of the first insertion section 134A. The starter rod 124 can be provided with an additional shoulder surface 160' radially outside the shoulder surface 160. An axial end surface 138' of the first insertion section 134A can directly face the additional shoulder surface 160', although an axial assembly clearance can be maintained therebetween. As illustrated, the joint 420 provides three completely discrete, non-overlapping, axial sections for carrying the bending loads, the torque loads, and the axial pullback loads, respectively.

Changes may be made in the above methods and systems without departing from the scope hereof. Also, aspects of various embodiments may be combined unless expressly prohibited. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A drill string joint for joining a drill head to a drill string along a central axis, the joint comprising:

a box end member defining, at a first axial end thereof, a first bore and a second deeper bore of smaller cross section than the first bore;

a pin end member defining a first insertion portion corresponding to the first bore and a second insertion portion corresponding to the second bore, wherein a conical tapered surface interface is defined between the second insertion portion and the second bore;

a plurality of cross pins extending through corresponding apertures formed through both the box end member, at the first bore, and the first insertion portion of the pin end member, the plurality of cross pins being located within a first axial span of the joint separate from a second axial span in which the conical tapered surface interface of the second insertion portion and the second bore is defined; and a torque coupling established between the box end member and the pin end member at an axial position between the first axial span and the second axial span.

2. The drill string joint of claim 1, wherein a diametrical clearance is provided between the first insertion portion and the first bore along the first axial span of the joint.

3. The drill string joint of claim 2, wherein the diametrical clearance is greater than 0.010 inch and less than 0.100 inch.

4. The drill string joint of claim 2, wherein the diametrical clearance is 0.018 inch to 0.021 inch.

5. The drill string joint of claim 1, wherein the plurality of cross pins are sized to fit loosely in the corresponding apertures of the pin end member and fit tightly in the corresponding apertures of the box end member.

6. The drill string joint of claim 1, wherein the plurality of cross pins includes four cross pins, all of which extend parallel to each other.

7. The drill string joint of claim 1, wherein the torque coupling includes a plurality of torque pins axially insertable into a plurality of blind bores provided in a circumferential array along a shoulder surface formed at the bottom of the first bore within the box end member.

8. The drill string joint of claim 7, wherein the plurality of torque pins are press-fit to the pin end member.

9. The drill string joint of claim 1, wherein the conical tapered surface interface between the second insertion portion and the second bore bears drill string bending loads in isolation, the conical tapered surface interface inhibiting the drill string bending loads from being borne by the first axial span and the torque coupling.

10. The drill string joint of claim 1, wherein the second axial span corresponding to the conical tapered surface interface between the second insertion portion and the second bore has a length greater than a length of the first axial span containing the plurality of cross pins.

11. The drill string joint of claim 1, wherein the joint provides three completely discrete, non-overlapping, axial sections for carrying the bending loads, the torque loads, and the axial pullback loads, respectively.

12. The drill string joint of claim 1, wherein the torque coupling is established by a plurality of torque pins positioned at least partially outside an outer profile defined by the first insertion portion.

13. The drill string joint of claim 1, wherein the torque coupling is established by complementary non-circular or polygonal cross-section profiles of an intermediate insertion portion of the pin end member between the first and second insertion portions.

14. A horizontal directional drilling system comprising:

a horizontal directional drilling machine;

a drill string terminating at a drill head and configured to be driven by the horizontal directional drilling machine to create an underground borehole extending at least partially horizontally between an entry point and an exit point; and the drill string joint of claim 1.

15. A method of assembling a drill string with a drill head along a central axis, the method comprising:

inserting a pin end member into a box end member along the central axis such that a first insertion portion of the pin end member is positioned within a first bore of the box end member at a first axial end of the box end member, and a second insertion portion of the pin end member is positioned within a second deeper bore of the box end member, the second bore having a smaller cross section than the first bore;

establishing a conical tapered surface interface between the second insertion portion and the second bore with the axial insertion of the pin end member to the box end member;

establishing a torque coupling with the axial insertion of the pin end member to the box end member; and inserting a plurality of cross pins perpendicular to the central axis through corresponding apertures formed through both the box end member, at the first bore, and the first insertion portion of the pin end member, the plurality of cross pins being located within a first axial span of the joint separate from a second axial span in which the conical tapered surface interface is established, wherein the torque coupling is established at an axial position between the first axial span and the second axial span.

16. The method of claim 15, wherein the insertion of the pin end member into the box end member to establish the conical tapered surface interface and the torque coupling leaves a diametrical clearance of at least 0.010 inch between the first insertion portion and the first bore along the first axial span of the joint.

17. The method of claim 15, wherein the insertion of the plurality of cross pins includes passing each of the plurality of cross pins, with clearance, through the corresponding aperture of the pin end member and engaging the cross pin tightly in the corresponding aperture of the box end member.

18. The method of claim 15, wherein the insertion of the plurality of cross pins includes inserting four cross pins, all along parallel insertion directions.

19. The method of claim 15, wherein the establishment of the torque coupling includes insertion of a plurality of torque transmitting elements, in the form of a plurality of torque pins, into a plurality of blind bores provided in a circumferential array along a shoulder surface formed at the bottom of the first bore within the box end member.

20. The method of claim 19, further comprising press-fitting the plurality of torque pins to the pin end member prior to the insertion.

21. The method of claim 15, wherein the conical tapered surface interface is established along the second axial span to define a length exceeding a length of the first axial span.

22. The method of claim 15, wherein the box end member is provided at a first end of a starter rod of the drill string, the method further comprising coupling a first drill rod to a second end of the starter rod, and coupling the drill head to the pin end member.

23. The method of claim 15, further comprising leaving the outside surfaces of the pin end member and the box end member exposed at the joint, free of any separate collar device.

24. The method of claim 15, wherein the axial position of the torque coupling is completely discrete and not overlapping with the first and second axial spans such that separate axial sections are provided for carrying the bending loads, the torque loads, and the axial pullback loads, respectively.

25. The method of claim 15, wherein the torque coupling is established by a plurality of torque pins positioned at least partially outside an outer profile defined by the first insertion portion.

26. The method of claim 15, wherein the torque coupling is established by complementary non-circular or polygonal cross-section profiles of an intermediate insertion portion of the pin end member between the first and second insertion portions.

27. A drill string coupler for establishing a joint between drill string components at a head end of a drill string of a horizontal directional drilling system, the coupler comprising:

a first coupling portion adapted for insertion into a first bore along a central axial direction;

a second coupling portion having a conical tapered surface adapted for insertion into a second bore smaller than the first bore, wherein the second coupling portion is provided along an axial span that is offset from an axial span of the first coupling portion;

a plurality of cross apertures formed through the first coupling portion to receive a corresponding plurality of cross pins; and a torque connection structure provided at an axial position between the respective axial spans of the first and second connection portions.

28. The drill string coupler of claim 27, further comprising a third coupling portion provided at an end opposite an end of the coupler defining the second coupling portion, the third coupling portion provided in an axial span that is offset from the respective axial spans of the first and second connection portions.

29. The drill string coupler of claim 27, wherein the axial position of the torque connection structure is completely discrete and not overlapping with the first and second axial spans such that separate axial sections are provided for carrying the bending loads, the torque loads, and the axial pullback loads, respectively.

30. The drill string coupler of claim 27, wherein the torque connection structure is established by a plurality of receptacles configured to receive torque connection pins at least partially outside an outer profile defined by the first insertion portion.

31. The drill string coupler of claim 27, wherein the torque connection structure is established by a non-circular or polygonal cross-section profile of an intermediate insertion portion between the first and second insertion portions.

* * * * *